United States Patent [19]

Foster

[11] 3,996,732

[45] Dec. 14, 1976

[54] SPINNING AND TWISTER RING ASSEMBLY

[75] Inventor: William A. Foster, Gastonia, N.C.

[73] Assignee: Whitinsville Spinning Ring Company, Whitinsville, Mass.

[22] Filed: June 23, 1975

[21] Appl. No.: 589,013

[52] U.S. Cl. ..... 57/122; 57/120

[51] Int. Cl.[2] ..... D01H 7/64; D01H 7/62

[58] Field of Search ..... 57/119, 120, 122, 123

[56] References Cited

UNITED STATES PATENTS

| | | | |
|---|---|---|---|
| 3,095,689 | 7/1963 | Keyser | 57/120 |
| 3,338,045 | 8/1967 | Kaiser | 57/122 X |

FOREIGN PATENTS OR APPLICATIONS

| | | | |
|---|---|---|---|
| 1,284,244 | 1962 | France | 57/120 |

*Primary Examiner*—Richard C. Queisser
*Assistant Examiner*—Charles Gorenstein
*Attorney, Agent, or Firm*—Norman S. Blodgett; Gerry A. Blodgett

[57] ABSTRACT

Spinning and twister ring assembly including a bracket having a rod extending around a groove in the periphery of the ring.

6 Claims, 7 Drawing Figures

SPINNING AND TWISTER RING ASSEMBLY

BACKGROUND OF THE INVENTION

In the art of spinning and twisting, it is the usual practice to mount a large number of rings at the front of a frame. In a given frame, the number of rings is limited and their centers are established during manufacture. Therefore, the only way in which larger bundles of yarn can be produced is by using larger rings. Since these rings are located in a row and since each is clamped in a holder, the size of the ring is limited by the space available for the holders between the rings. Reducing the size of the holders (so that the rings can be made larger) results in a weak holder which can become cracked, or otherwise inoperative. In some frames, the space allowable between rings is limited by the presence of a separator blade which cannot be located close to moving parts, lest rubbing cause aluminum or other metallic particles to become imbedded in the lubricant and on the yarn. These and other difficulties experienced with the prior art devices have been obviated in a novel manner by the present invention.

It is, therefore, an outstanding object of the invention to provide a spinning and twisting ring assembly, including a holder which allows the rings to be placed very close together.

Another object of the present invention is the provision of a ring assembly including a holder which clamps the ring with substantially equal pressure throughout its periphery, so that distortion of the ring does not take place.

A further object of the present invention is the provision of a ring assembly in which the holder is constructed in such a manner that the ring can be readily removed and replaced.

It is another object of the instant invention to provide a ring assembly which is simple in construction, which is inexpensive to manufacture, and which is capable of a long life of useful service with a minimum of maintenance.

A still further object of the invention is the provision of a ring assembly which permits a large size of ring to be used, thus resulting in a large bundle of yarn.

With these and other objects in view, as will be apparent to those skilled in the art, the invention resides in the combination of parts set forth in the specification and covered by the claims appended hereto.

SUMMARY OF THE INVENTION

In general, the invention consists of a spinning and twisting ring assembly having a ring with an annular groove formed on its outer surface, having a bracket adapted to be fastened to a spinning or twisting frame, and having a rod with at least one end attached to the bracket and with its intermediate portion residing in the said groove.

More specifically, the bracket embraces a substantial portion of the periphery of the ring and the bracket and ring are locked together in this portion by a tongue-and-groove interconnection. The rod passes through a bore in an abutment formed on the bracket, the abutment being tapered to minimize the lateral extension of the bracket, while providing the maximum strength.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
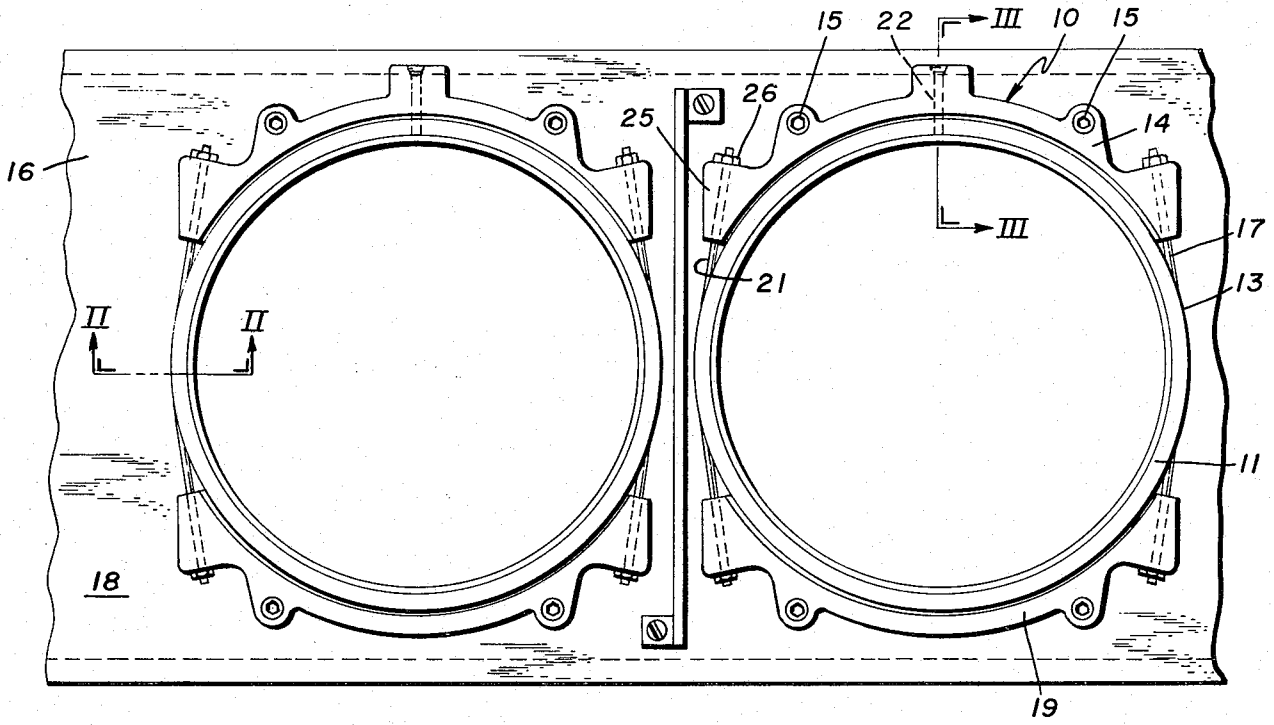
FIG. 1 is a plan view of a spinning ring assembly incorporating the principles of the present invention.
Figure 3:
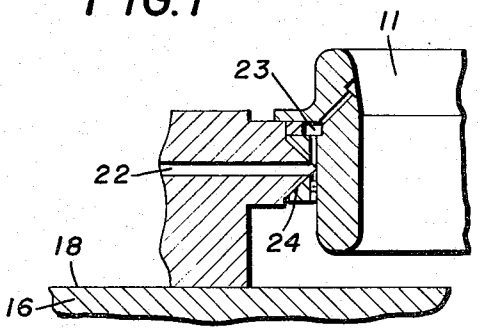
FIG. 3 is a vertical sectional view of the assembly somewhat enlarged taken on the line III—III of FIG. 1.
Figure 2:
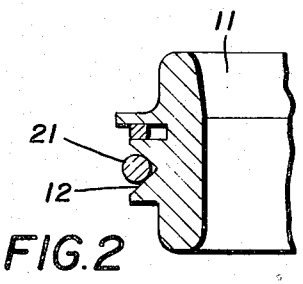
FIG. 2 is a vertical sectional view somewhat enlarged of the assembly taken on the line II—II of FIG. 1.

Referring first to FIGS. 1, 2, and 3, it can be seen that the spinning ring assembly, indicated generally by the reference numeral 10, consists of a spinning ring 11 having an annular groove 12 formed on its outer periphery 13. As is evident in FIG. 2, the groove 12 is V-shaped. The bracket 14 is fastened to a spinning frame 16 by means of bolts 15. The rod 17 has one end attached to the bracket 14 and has its intermediate portion residing in the groove 12. The bracket 14 is fastened to a horizontal surface 18 of the frame and embraces at least partly around the ring 11. A bracket 19, which is similar to bracket 14, engages the diametrically-opposite portion of the ring 11 and the rod 17 extends between the two brackets and lies in the groove 12 on one side of the ring. The second rod 21 joins the two brackets and lies in the groove on the other side of the ring. A lubricant passage 22 passes through the bracket 14 and joins a lubricant passage 23 formed in the ring 11. The bracket 14 embraces a substantial portion of the periphery 13 of the ring and the bracket and ring are locked together in this portion by a tongue-and-groove interconnection 24 (see FIG. 3). As is best evident in FIG. 1, the rod 21 passes through a bore in an abutment 25 formed on the bracket. The abutment is tapered to minimize the laterial extension of the bracket 14 toward the corresponding bracket of the adjacent ring while maximizing its strength. The end of the rod extends out of the abutment, is threaded, and is provided with a tightening nut 26.

The operation of the invention will now be readily understood in view of the above description. On a conventional ring spinning or twister frame, the rings are held in place by an aluminum, cast iron, or steel holder. On any given gage of machine, the diameter of the rings is restricted, because there must be enough material on each side of the holder to offer strength to the ring and holder unit. Also, occasionally a holder will rub the separator plate and metal deposits will become mixed with ring oil and will mass onto the yarn which condition is very undesirable. Any effort to increase the ring diameter in a conventional holder results in boring the hole in the holder larger and, therefore, reducing the strength of the unit and causing the ring or the holder to break. The purpose of the present invention is to allow a larger ring to be fitted into a frame and at the same time to increase the strength of the total unit. The round steel wire or rod that is used, even if it should happen to rub against a separator blade, it will make only point contact and this will greatly reduce deposits on the yarn package. The tongue-and-groove assembly also prevents the ring from slipping or being vibrated out of position in the holder. The holder can be made for steel wicked rings, rings drilled for automatic lubrication, and porous sintered metal rings, as long as the ring section is thick enough to allow machining of the groove. The principles of the notched tongue-and-groove ring and holder drawn together with threaded rods insures minimal ring distortion because, while the two halves of the holder are being squeezed together on the ring by tightening the nuts on the rod, the rod itself tends to straighten out, because of increased tension. It, therefore, applies counter pressure on the sides of the ring, thereby tending to equalize pressures being applied on the circumference of the ring. Another advantage of the invention is the ease in which the ring can be replaced in the holder where other types of holders have riveted and sealed ring and reservoirs. The present invention has two screws to hold the reservoir cover and no sealant. This cover then can easily be removed and replaced without any damage to any part of the ring cover or holder. In other words, after the initial purchase of the ring and holder assembly, it will be necessary to replace only the ring in the plant and it will not be necessary to send the complete unit back to the factory for rebuilding. The operator must take care, when installing the ring, that tightening the nuts on the wires does not rotate the ring in front and shear the wick tails that pass to the reservoir.

Figure 4:
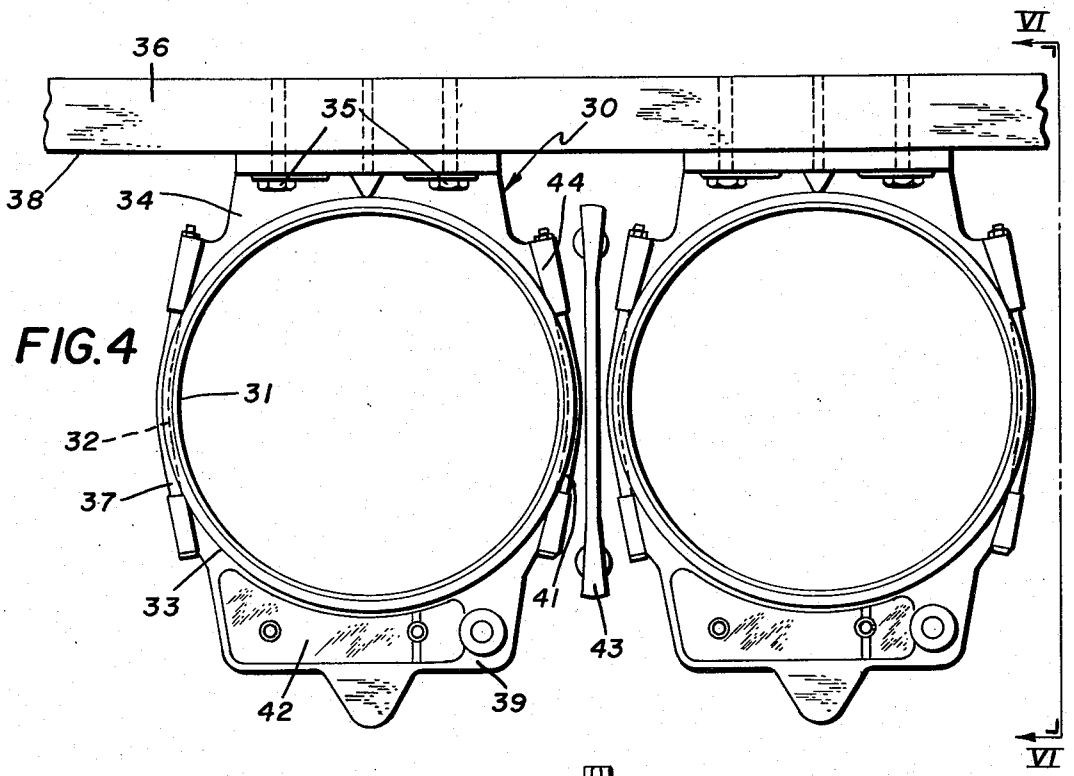
FIG. 4 is a plan view of a revised form of the invention.
Figure 5:
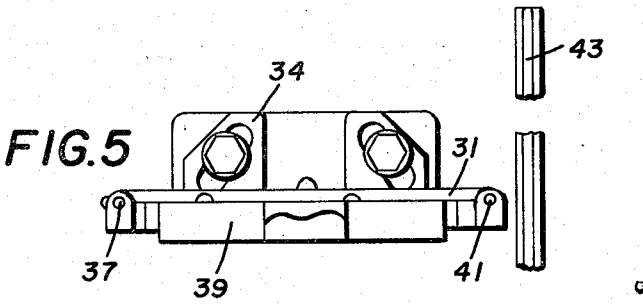
FIG. 5 is a front elevational view of the assembly of FIG. 4.
Figure 6:
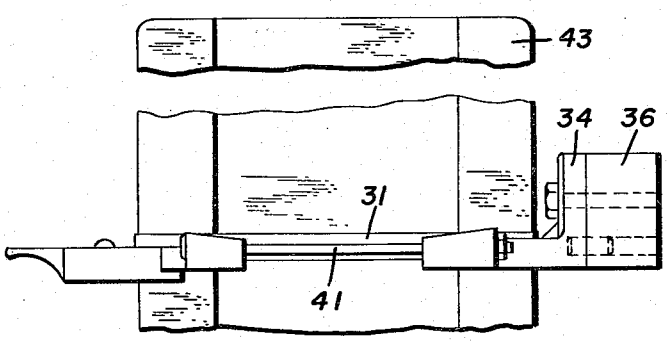
FIG. 6 is a side elevational view taken on the line VI—VI of FIG. 4.

Referring next to FIGS. 4, 5, and 6, the spinning ring assembly 30 is shown as having a spinning ring 31 with an annular groove 32 formed on its outer periphery 33. The bracket 34 is fastened by bolts 35 to a vertical surface 38 of a spinning frame 36. The rod 37 has one end attached to the bracket 34, while the other end is attached to a similar bracket 39. Another rod 41 extends around the ring 31 on the other side joining the two brackets. As has been stated, the bracket 34 is fastened to the vertical surface 38 of the frame 36 and embraces a portion of the ring facing the vertical surface. The bracket 39 embraces the diametrically-opposite portion of the ring and the rod 36 joins the two brackets on one side of the ring, while the other rod 41 joins the two brackets on the other side of the ring. A lubrication cover 42 covers a lubrication pad and a separator blade 43 is shown lying between the ring and holder and an adjacent assembly. The bracket 34 is provided with an abutment 44 through which the rod 41 passes and is fastened. Similar abutments are provided on the other bracket for the same purpose, the abutments being tapered to assure that no part of the holder comes too close to the separator blade 43.

Figure 7:
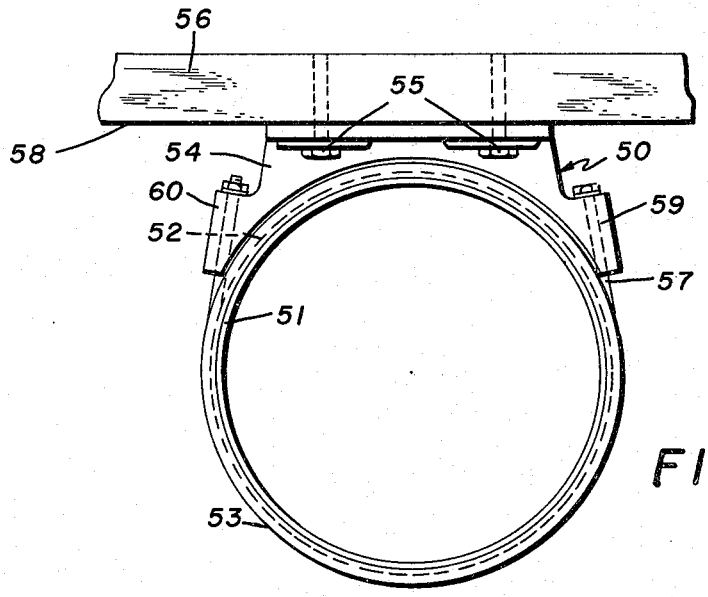
FIG. 7 is a plan view of a still further modification of the invention.

FIG. 7 shows a spinning ring assembly 50 in which the spinning ring 51 is provided with an annular groove 52 extending around its periphery 53. A single bracket 54 is fastened to a vertical surface 58 of a spinning frame 56 by means of bolts 55. A rod 57 is fastened and passes through an abutment 59 at one side of the bracket 54. The rod extends around the ring, resides in the groove 52, and is fastened to an abutment 60 located at the other side of the bracket 54. As is clear from the drawing, the rod extends around more than 180° of the periphery of the ring, lies in the groove, and is connected on both ends to the same bracket. The bracket itself, of course, embraces a substantial portion of the ring and a tongue-and-groove interconnections exists between the two.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Spinning and twisting ring assembly, comprising
a. a ring having an annular groove formed on its outer surface,
b. a bracket adapted to be fastened to a spinning or twister frame, the bracket being fastened to a horizontal surface and extending at least partly around the ring, and
c. a rod having at least one end attached to the bracket and having its intermediate portion residing in the groove, wherein a second bracket engages the diametrically-opposite portion of the ring, and wherein the rod extends between the two brackets and lies in the groove on one side of the ring, while a second rod joins the brackets and lies in the groove on the other side of the ring.

2. A ring assembly as recited in claim 1, wherein a lubricant passage extends through the bracket and joins a lubricant passage in the ring.

3. A ring assembly as recited in claim 1, wherein the bracket embraces a substantial portion of the periphery of the ring, and wherein the bracket and ring are locked together in this portion by a tongue-and-groove interconnection.

4. Spinning and twisting ring assembly, comprising
a. a ring having an annular groove formed on its outer surface,
b. a bracket adapted to be fastened to a spinning or twister frame, the bracket being fastened to a vertical surface and embracing a portion of the ring facing the vertical surface, and
c. a rod having at least one end attached to the bracket and having its intermediate portion residing in the groove, wherein a second bracket embraces the diametrically-opposite portion of the ring, and wherein the rod joins the two brackets on one side of the ring, while another rod joins the two brackets on the other side of the ring.

5. Spinning and twisting ring assembly, comprising
a. a ring having an annular groove formed on its outer surface,
b. a bracket adapted to be fastened to a spinning or twister frame, and
c. a rod having at least one end attached to the bracket and having its intermediate portion residing in the groove, wherein the rod passes through a bore in an abutment formed on the bracket, the abutment being tapered to minimize the lateral extension of the bracket.

6. A ring assembly as recited in claim 5, wherein the end of the rod extends out of the abutment, is threaded, and is provided with a tightening nut.

* * * * *